US010364125B2

(12) United States Patent
Blair et al.

(10) Patent No.: US 10,364,125 B2
(45) Date of Patent: Jul. 30, 2019

(54) CABLE REEL EDDY CURRENT BRAKE

(71) Applicant: Conductix, Inc., Omaha, NE (US)

(72) Inventors: Martin Blair, Gretna, NE (US); Benjamin B. Hiebenthal, Fremont, NE (US); Erik Antonson, Omaha, NE (US)

(73) Assignee: CONDUCTIX, INC., Omaha, NE (US)

( * ) Notice: Subject to any disclaimer, the term of this patent is extended or adjusted under 35 U.S.C. 154(b) by 320 days.

(21) Appl. No.: 15/136,209

(22) Filed: Apr. 22, 2016

(65) Prior Publication Data

US 2016/0311642 A1 Oct. 27, 2016

Related U.S. Application Data

(60) Provisional application No. 62/152,236, filed on Apr. 24, 2015.

(51) Int. Cl.
*B65H 75/44* (2006.01)

(52) U.S. Cl.
CPC ... *B65H 75/4442* (2013.01); *B65H 2701/526* (2013.01)

(58) Field of Classification Search
CPC ..... B65H 75/4442; B65H 2701/526
See application file for complete search history.

(56) References Cited

U.S. PATENT DOCUMENTS

| | | | |
|---|---|---|---|
| 2,846,631 | A | 8/1958 | Vogt |
| 5,064,029 | A | 11/1991 | Araki et al. |
| 5,711,404 | A | 1/1998 | Lee |
| 6,234,417 | B1 | 5/2001 | Sauder et al. |
| 6,488,224 | B1 | 12/2002 | Hiebenthal |
| 2003/0160122 | A1 | 8/2003 | Girtman et al. |
| 2010/0308149 | A1 | 12/2010 | Allington et al. |

FOREIGN PATENT DOCUMENTS

| | | |
|---|---|---|
| EP | 1279637 | 1/2003 |
| EP | 1915273 | 4/2008 |
| EP | 2653428 | 10/2013 |

OTHER PUBLICATIONS

Machine Translation of EP 2 653 428 A1, Oct. 23, 2013. (Year: 2013).*

Notification of Transmittal of the International Search Report and the Written Opinion of the International Searching Authority—dated Aug. 2, 2016.

* cited by examiner

*Primary Examiner* — William E Dondero

(74) *Attorney, Agent, or Firm* — Ryan T. Grace; Advent, LLP

(57) ABSTRACT

A reel device may include a stator and a rotor rotationally coupled with the stator. The rotor may include a drum for spooling a cable. The reel device may also include a biasing mechanism configured to rotate the rotor to spool the cable onto the drum, and a magnet connected to one of the stator or the rotor. The other of the stator or the rotor may include a conductive material that interfaces with the magnet when the rotor is turned to slow spooling of the cable onto the drum.

20 Claims, 8 Drawing Sheets

CABLE REEL EDDY CURRENT BRAKE

CROSS-REFERENCE TO RELATED APPLICATIONS

The present application claims the benefit under 35 U.S.C. § 119(e) of U.S. Provisional Application Ser. No. 62/152,236, filed Apr. 24, 2015, and titled "CABLE REEL EDDY CURRENT BRAKE," which is herein incorporated by reference in its entirety.

BACKGROUND

Eddy currents, which may also be referred to as "Foucault" currents, are loops of electrical current induced within conductors by a changing magnetic field in the conductor. Eddy currents flow in closed loops within the conductors, in planes perpendicular to the magnetic field.

SUMMARY

This Summary is provided to introduce a selection of concepts in a simplified form that are further described below in the Detailed Description. This Summary is not intended to identify key and/or essential features of the claimed subject matter. Also, this Summary is not intended to limit the scope of the claimed subject matter in any manner.

Aspects of the disclosure relate to a reel device that can include a stator and a rotor rotationally coupled with the stator. The rotor may include a drum for spooling a cable. The reel device can also include a biasing mechanism configured to rotate the rotor to spool the cable onto the drum, and a magnet connected to one of the stator or the rotor. The other of the stator or the rotor may include a conductive material that interfaces with the magnet when the rotor is turned to slow spooling of the cable onto the drum.

DRAWINGS

The Detailed Description is described with reference to the accompanying figures. The use of the same reference numbers in different instances in the description and the figures may indicate similar or identical items.

FIG. 1 is an isometric view illustrating a reel device with a drum for spooling a cable, where the drum is included with a rotor rotationally coupled with a stator, a biasing mechanism rotates the rotor to spool the cable onto the drum, and a disk of conductive material connected to the stator interfaces with magnets connected to the rotor to slow spooling of the cable onto the drum in accordance with an example embodiment of the present disclosure.

Figure 5:
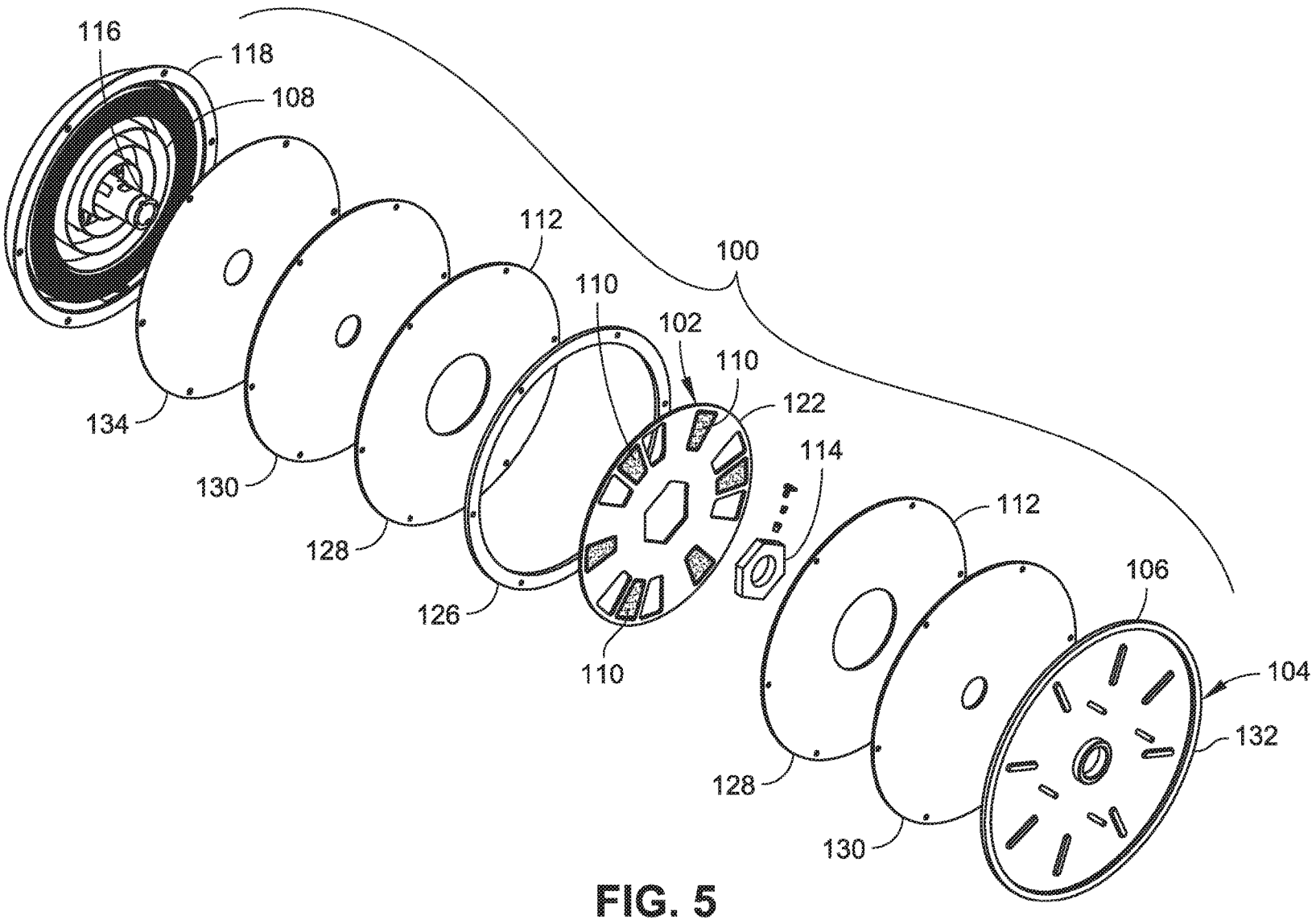

FIG. 5 is a partial exploded isometric view illustrating a reel device with a drum for spooling a cable, where the drum is included with a rotor rotationally coupled with a stator, a biasing mechanism rotates the rotor to spool the cable onto the drum, and two disks of conductive material connected to the rotor interface with magnets connected to the stator to slow spooling of the cable onto the drum in accordance with an example embodiment of the present disclosure.

Figure 6:
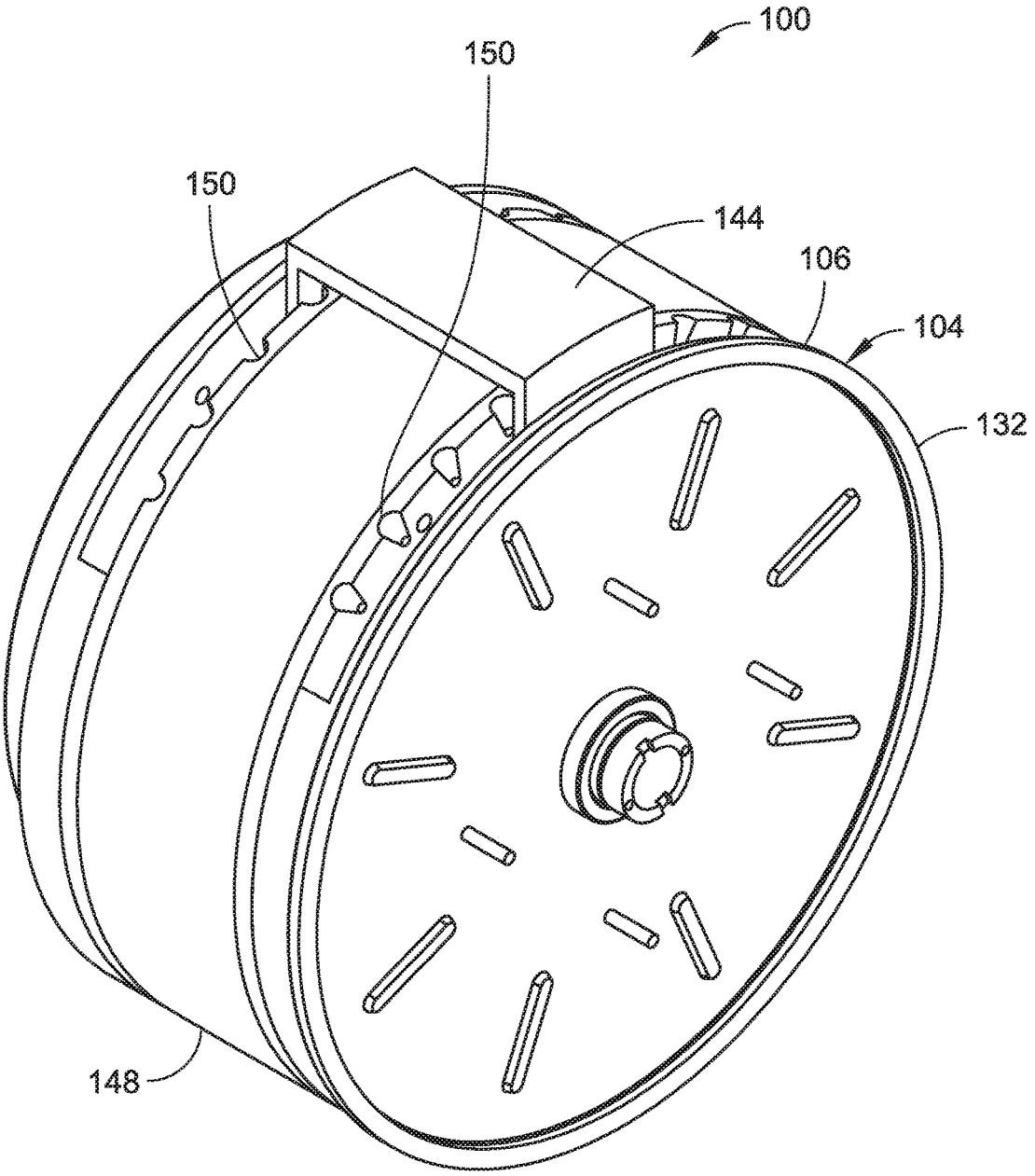

FIG. 6 is a partial isometric view illustrating a reel device with a drum for spooling a cable, where the drum is included with a rotor rotationally coupled with a stator, a biasing mechanism rotates the rotor to spool the cable onto the drum, and a disk of conductive material connected to the stator interfaces with magnets connected to the rotor to slow spooling of the cable onto the drum, and where a housing that encloses the conductive disk and the magnets includes an adjustment mechanism to adjust the distances between the magnets and the conductive disk in accordance with example embodiments of the present disclosure.

Figure 7:
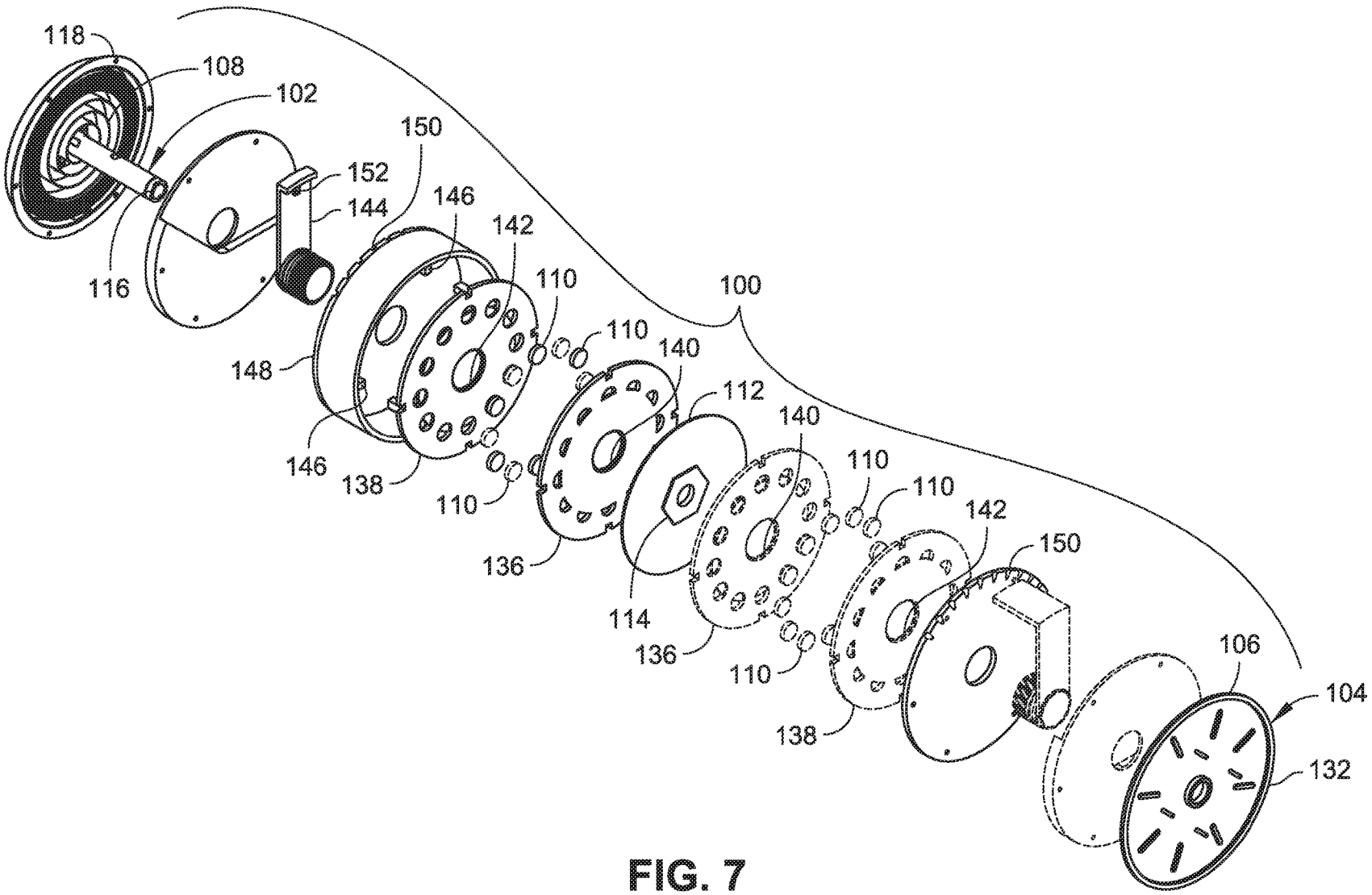

FIG. 7 is a partial exploded isometric view of the reel device illustrated in FIG. 6.

Figure 8:
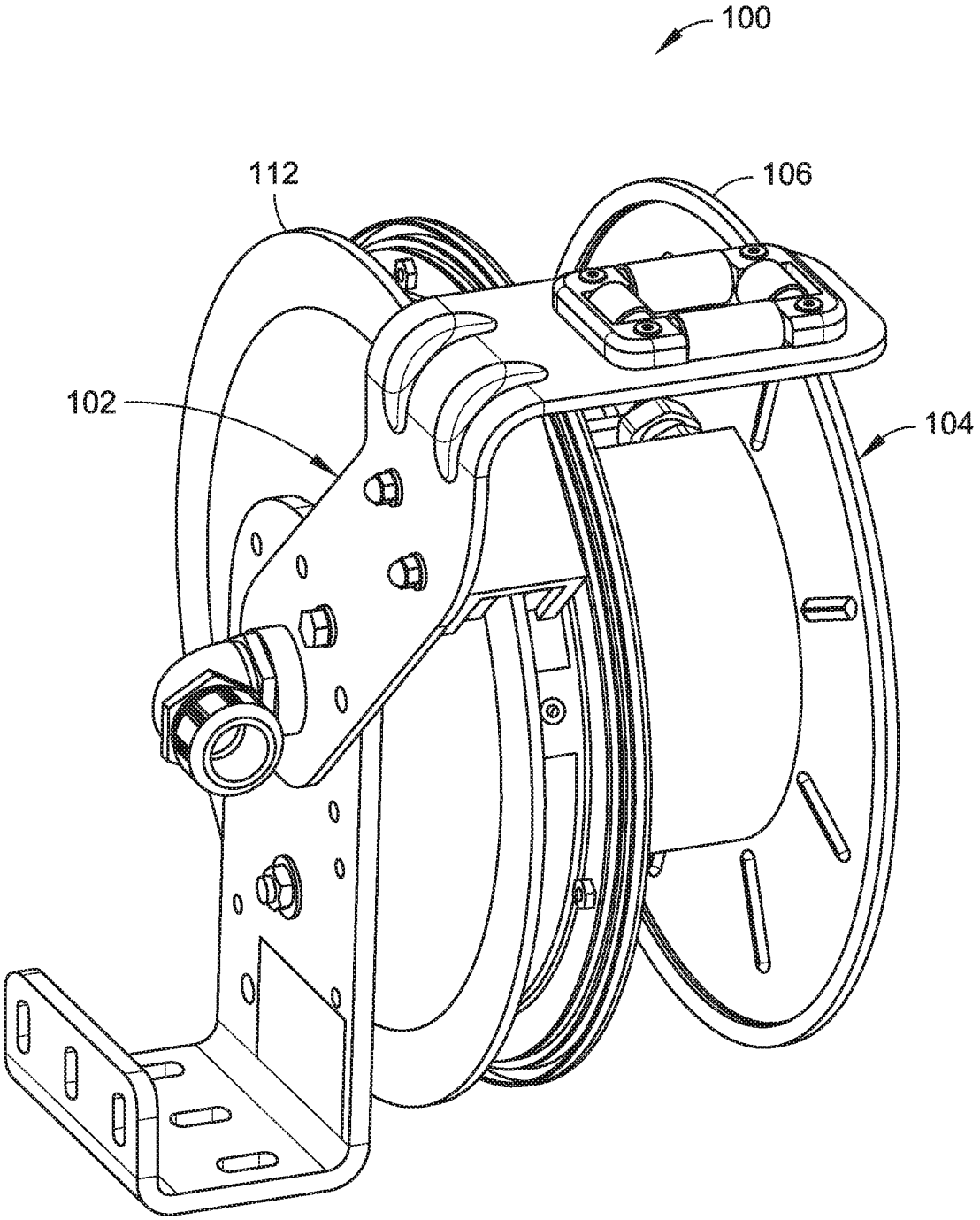

FIG. 8 is an isometric view illustrating a reel device with a drum for spooling a cable, where the drum is included with a rotor rotationally coupled with a stator, a biasing mechanism rotates the rotor to spool the cable onto the drum, and a disk of conductive material connected to the rotor interfaces with magnets connected to the stator to slow spooling of the cable onto the drum in accordance with an example embodiment of the present disclosure.

DETAILED DESCRIPTION

Spring driven cable reels provide energy to recoil a cable using a spring mechanism (e.g., a spring motor). However, a spring motor may provide more force than necessary to recoil a cable. The additional force may cause rapid cable acceleration, increased retraction speeds, and/or whipping of the cable as it is retracted. The application of a magnetic brake (e.g., an eddy current brake) to a cable reel drum is described herein. In some embodiments, an eddy current brake can provide a resistive braking force to limit the retraction speed of a cable and/or to facilitate controlled recoil of the cable. Further, the eddy current brake's performance can be linear, or at least approximately linear, with respect to operating temperature. The eddy current brake may also have minimal or no parasitic start-up and/or operating torque loss (e.g., due to contactless design).

Referring generally to FIGS. 1 through 8, reel devices 100 are described. A reel device 100 can be used to implement, for example, an eddy current brake on a cable reel. In embodiments of the disclosure, a reel device 100 may include a stator 102 and a rotor 104 rotationally coupled with the stator 102. The rotor 104 can include a drum assembly 106 for spooling a cable (not shown). The reel device 100 may also include a biasing mechanism configured to rotate the rotor 104 to spool the cable onto the drum assembly 106. For example, the reel device 100 can include a spring motor 108 and/or one or more other biasing devices to spool the cable onto the drum assembly 106. In some embodiments, the spring motor can be a spring motor having a diameter of about twelve inches (12 in.). However, this diameter is provided by way of example and is not meant to limit the present disclosure. In other embodiments, a spring motor can have a different diameter. Further, a reel device 100 may employ one or more other biasing mechanisms, including, but not necessarily limited to: mechanical biasing devices, electromechanical biasing devices (e.g., electric motors), and so on. For example, a reel device 100 may include a linear spring motor and/or one or more other biasing devices that store potential energy, converted to mechanical work, to retract the cable. A reel device 100 may also include a pneumatic motor, a hydraulic motor, and so forth.

In embodiments of the disclosure, the reel device 100 includes one or more magnets 110 (e.g., a permanent magnet or permanent magnets) connected to the stator 102 and/or the rotor 104. Another component (e.g., the stator 102 and/or the rotor 104) can include a conductive material 112 that interfaces with the magnets 110 when the rotor 104 is turned to slow spooling of the cable onto the drum assembly 106. The conductive material 112 can be aluminum, copper, and/or one or more other conductive materials. As described herein, either one of the conductive material 112 or the magnet 110 turns with the rotor 104, while the other of the conductive material 112 or the magnet 110 remain stationary with the stator 102. For the purposes of the present disclosure, the term "stationary" shall be understood as linked to the motion of the stator 102, which is stationary to the extent that the rotor 104 turns about it, but not stationary in an absolute sense. For instance, the stator 102 may move in the hands of an operator, be jostled about a mounting point, and so forth.

Figure 1:
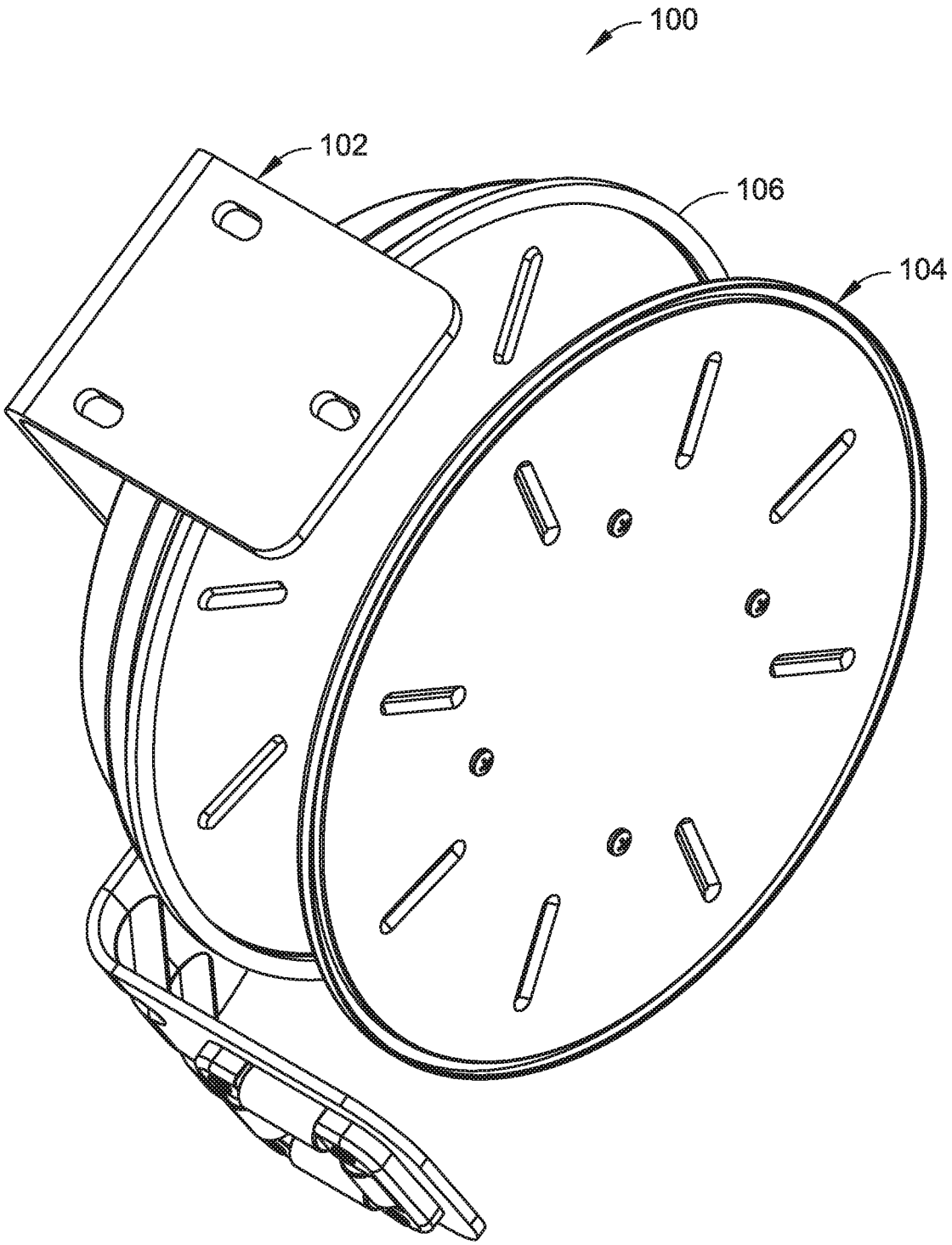
Figure 2:
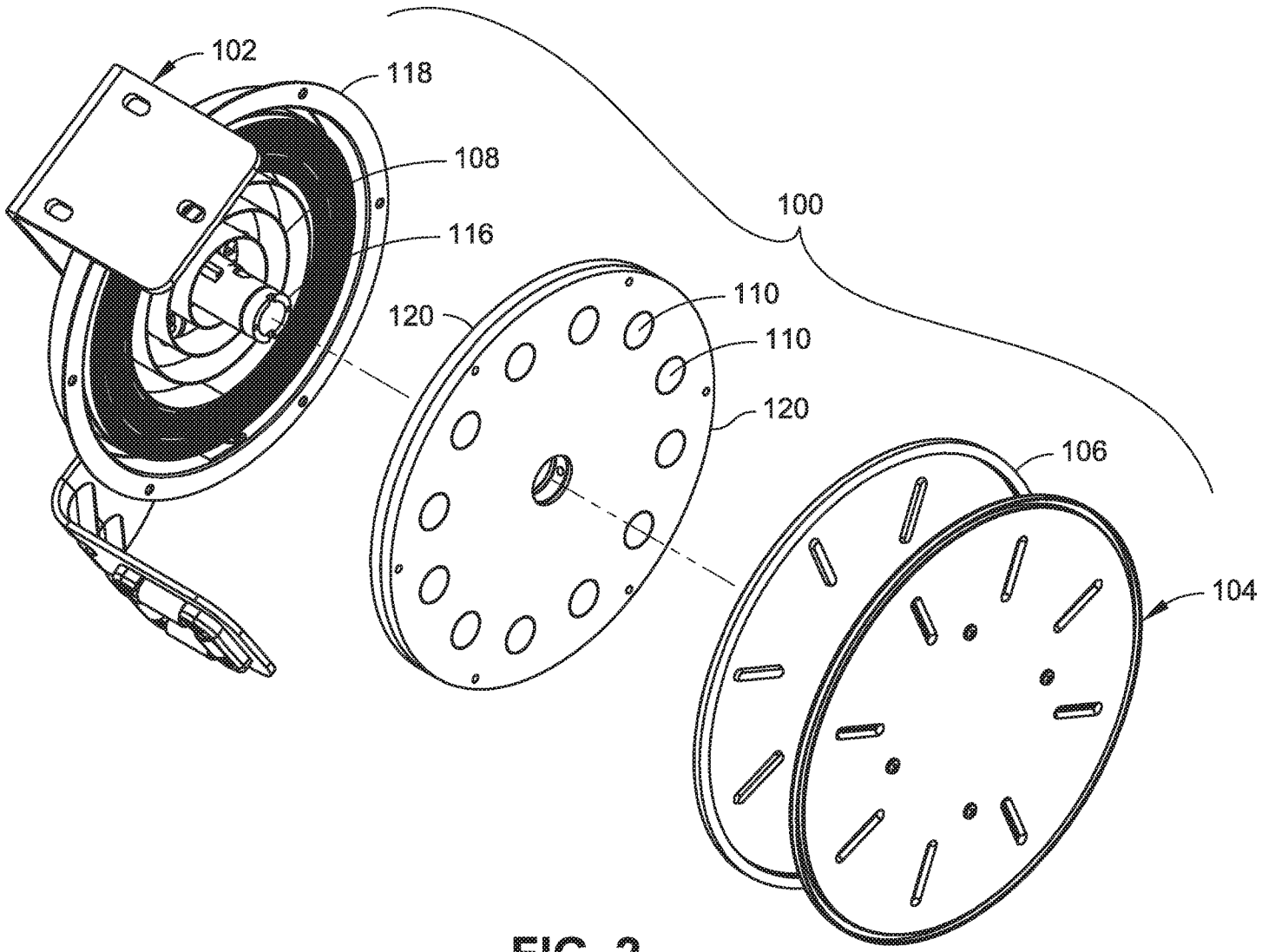
FIG. 2 is an exploded isometric view of the reel device illustrated in FIG. 1.
Figure 3:
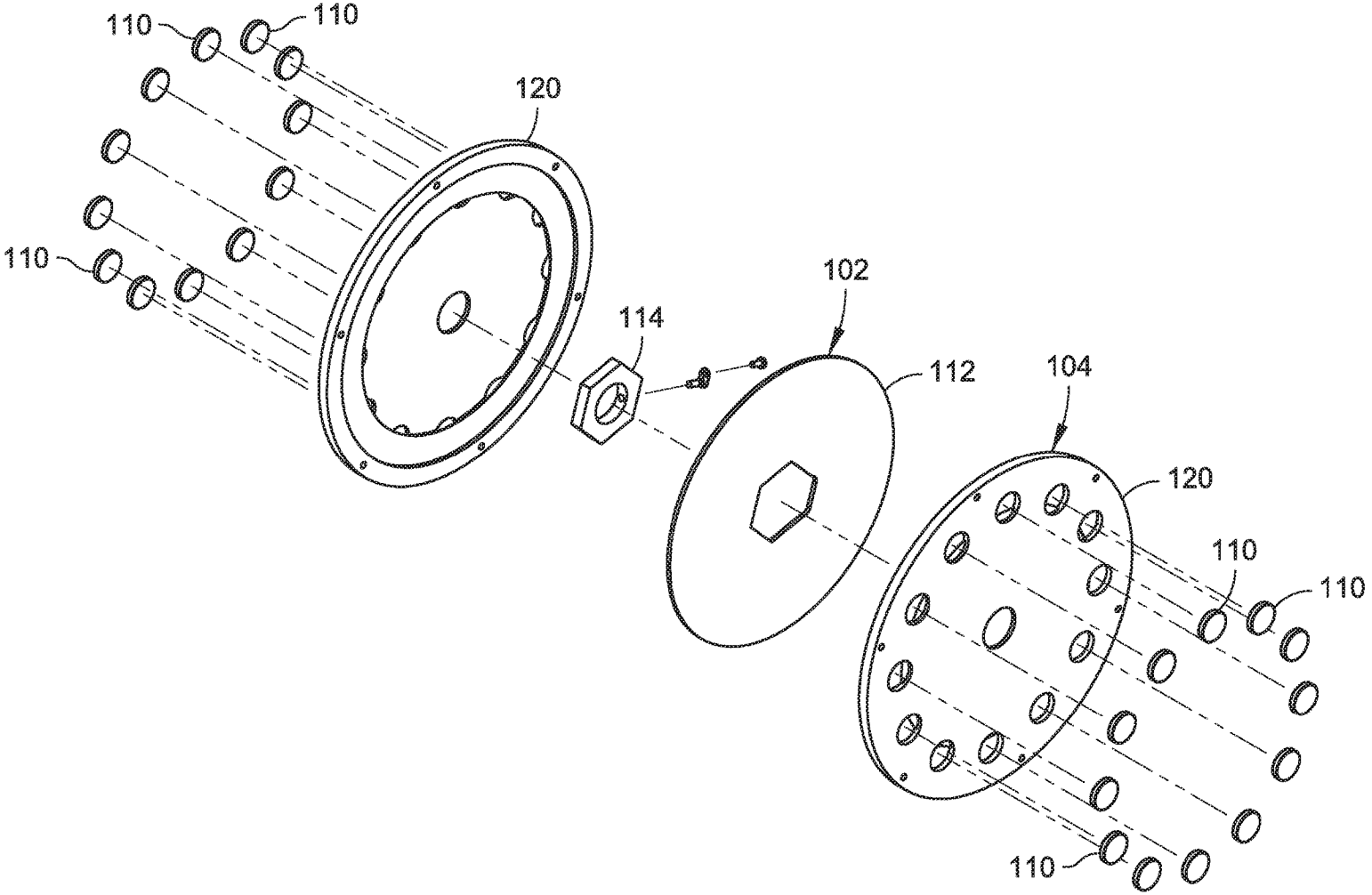
FIG. 3 is an exploded isometric view of a magnet housing for the reel device illustrated in FIG. 1.

Referring to FIGS. 1 through 3, in some embodiments eddy current is generated as magnets 110 connected to a rotor 104 move adjacent to the surface of a disk of conductive material 112 connected to a stator 102. For example, a drive hub 114 with a hexagonally-shaped periphery is fixedly attached to a shaft 116 of the stator 102 (e.g., by a set screw, a spring biased fastener, etc.). A spring housing 118 is also attached to the shaft 116 of the stator 102 and rotates about the shaft 116. The spring housing 118 is connected to the spring motor 108, which is fixedly connected to the shaft 116 for biasing the spring housing 118. A disk of conductive material 112 with a hexagonally-shaped aperture interfaces with the drive hub 114 to remain stationary with the stator 102 as the rotor 104 turns about the stator 102. In embodiments of the disclosure, the disk of conductive material 112 can be retained between two magnet housings 120 (e.g., using screws or other fasteners). The magnet housings 120 can be coupled with the spring housing 118 and the drum assembly 106, which can include, for instance, two spool flanges and a drum.

The magnet housings 120 may each include one or more magnets 110. In some embodiments, each magnet housing 120 can include twelve (12) circular magnets 110. However, this number of magnets 110 is provided by way of example and is not meant to limit the present disclosure. In other embodiments, a magnet housing 120 can include more or fewer magnets 110. Further, circular magnets 110 are provided by way of example and are not meant to limit the present disclosure. A reel device 100 may employ one or more other magnets having different geometries, including, but not necessarily limited to, other geometric shapes (e.g., any polygonal shape). In embodiments of the disclosure one or more magnets 110 can be encapsulated (e.g., to reduce environmental interaction). For example, a group (e.g., a circular ring) of magnets 110 can be encapsulated by placing the magnets 110 in an injection mold and then molding plastic material around the magnets 110 (e.g., to form a magnet housing 120). In other embodiments, the magnets 110 can be encapsulated in a frame. For example, magnets 110 can be glued (e.g., using epoxy) into an aluminum frame forming a magnet housing 120. In other embodiments, the magnets 110 can be captured by a magnet housing. For example, opposing sides of a magnet housing can be fastened (e.g., screwed, adhered) together to retain the magnets 110 within the magnet housing. It should be noted that a circular ring of magnets 110 is provided by way of example and is not meant to limit the present disclosure. Thus, in other embodiments different arrangements of the magnets 110 can be employed, including, but not necessarily limited to, geometries such as rectangular, square, triangular, hexagonal, etc. Further, a group of magnets 110 can be arranged in the same plane, or at least substantially the same plane. In other embodiments, one or more magnets 110 and/or groups of magnets 110 may be arranged in different planes (e.g., parallel planes).

Figure 4:
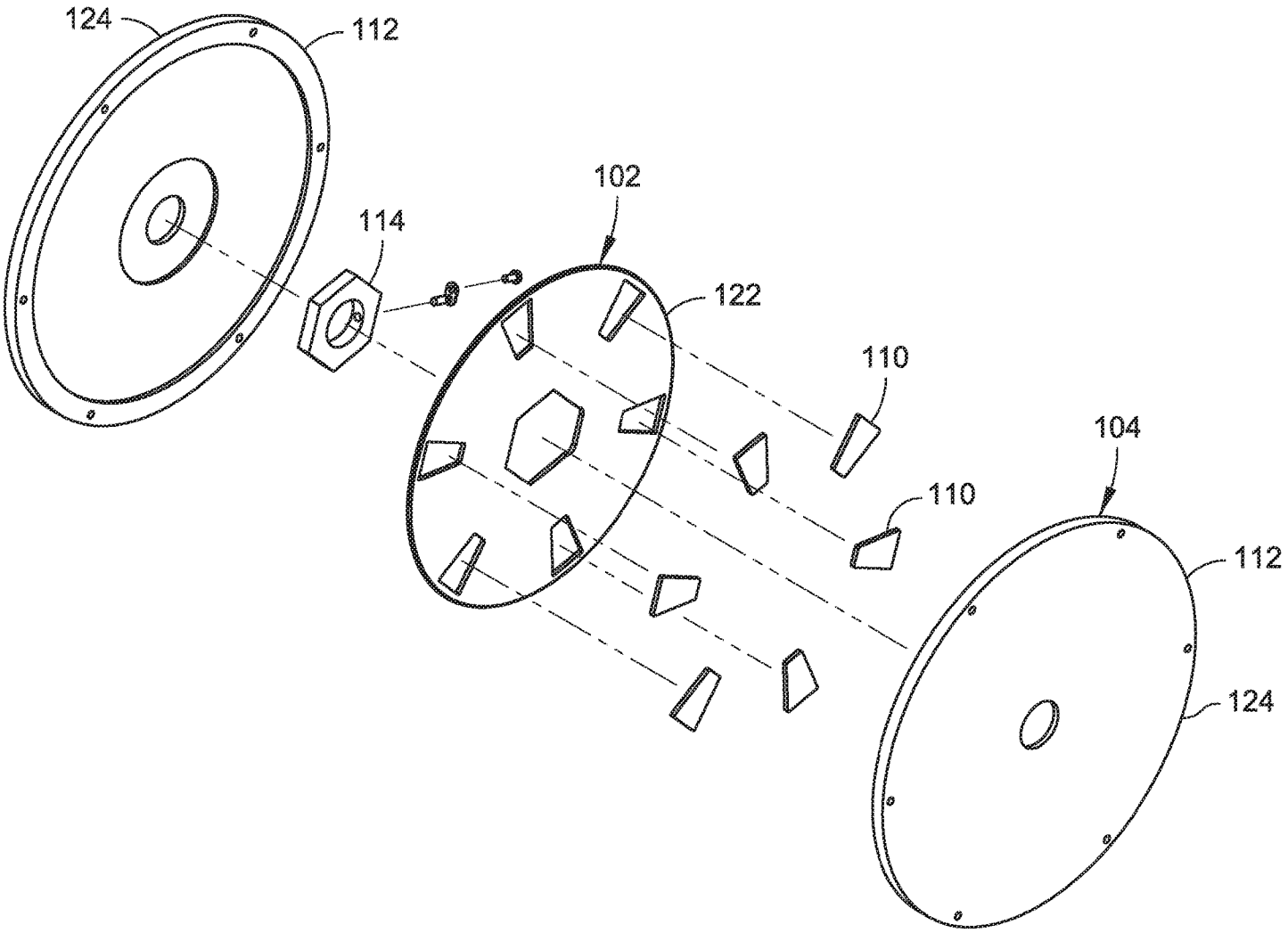
FIG. 4 is an exploded isometric view illustrating another magnet housing for a reel device, such as the reel device shown in FIG. 1, in accordance with an example embodiment of the present disclosure.

With reference to FIG. 4, in some embodiments eddy current is generated as one or more disks of conductive material 112 connected to a rotor 104 move adjacent to generally pie-shaped magnets 110 connected to a stator 102. For example, a drive hub 114 with a hexagonally-shaped periphery is fixedly attached to a shaft of the stator 102 (e.g., by a set screw, a spring biased fastener, etc.). A magnet frame 122 with a hexagonally-shaped aperture interfaces with the drive hub 114 to remain stationary with the stator 102 as the rotor 104 turns about the stator 102. In embodiments of the disclosure, the magnet frame 122 can be retained between two conductive material housings 124 (e.g., using screws or other fasteners). The conductive material housings 124 can be coupled with a spring housing 118 and a drum assembly 106 (e.g., as previously described). In some embodiments, the magnets 110 can be encapsulated in the magnet frame 122, e.g., by gluing the magnets 110 into an aluminum magnet frame 122.

In some embodiments, one or more of the magnets 110 can be formed of a magnetic material, such as neodymium. However this magnetic material is provided by way of example and is not meant to limit the present disclosure. In other embodiments, one or more magnets 110 can be constructed from another material, such as another magnetic material. For example, one or more magnets 110 can include a neodymium alloy material. Further, in some embodiments, one or more magnets 110 may be configured as an electromagnet, e.g., where the reel device 100 includes a power supply for powering the electromagnet. In some embodiments, current through an electromagnet can be varied to control the magnetic field strength, e.g., to control the brake force.

In some embodiments, a reel device 100 as described herein can retract a cable at a rate of between about one foot per second (1 ft/s) and about two feet per second (2 ft/s). However this range is provided by way of example and is not meant to limit the present disclosure. In other embodiments, a reel device 100 can retract a cable at a rate less than about one foot per second (1 ft/s), greater than two feet per second (2 ft/s), and so forth. In some embodiments, a reel device 100 can absorb at least approximately ninety percent (90%) of excessive torque under maximum load, e.g., at a line speed limit of about one foot per second (1 ft/s). In some embodiments, the brake force can be adjusted by increasing and/or decreasing the number of magnets 110 (e.g., fixed permanent magnets), adjusting the diameter of the disk of conductive material 112, adjusting the thickness of the disk of conductive material 112, adjusting the spacing of the magnets 110 from the disk of conductive material 112, varying the magnetic field strength (e.g., by varying current through an electromagnet), and so forth.

Referring now to FIG. 5, a drive hub 114 with a hexagonally-shaped periphery can be fixedly attached to a shaft 116 of the stator 102 (e.g., by a set screw, a spring biased fastener, etc.). A spring housing 118 can also be attached to the shaft 116 of the stator 102 to rotate about the shaft 116. A magnet frame 122 with a hexagonally-shaped aperture interfaces with the drive hub 114 to remain stationary with the stator 102 as the rotor 104 turns about the stator 102. A spacer ring 126 positioned around the magnet frame 122 can be retained between two conductive material housings (e.g., using screws or other fasteners). The conductive material housings may each include an inner housing 128 (e.g., formed of conductive material adjacent to the magnets 110) and an outer housing 130. By adjusting the thickness of the spacer ring 126, the spacing of the magnets 110 from the conductive material 112 of the conductive material housings can be adjusted to set the brake force. The conductive material housings can be coupled with the spring housing 118 and a drum assembly, which can include a spool flange 132, a drum (not shown), and another spool flange (not shown), where the drum is positioned between the two spool flanges.

In some embodiments, a magnetic shield 134 can be positioned between the conductive material housing and the spring motor 108. For example, a magnetic shield 134 formed of sheet steel having a thickness of at least approximately sixty one-thousandths of an inch (0.060 in.) can be positioned between an outer housing 130 and the spring housing 118. However, this thickness is provided by way of example and is not meant to limit the present disclosure. In other embodiments, a magnetic shield may have a different thickness. Further, a magnetic shield may be constructed using one or more different materials (e.g., in addition to, or in place of, sheet steel). In embodiments of the disclosure, the magnetic shield 134 may prevent or reduce the tendency of the spring motor 108 to be drawn toward the magnets 110.

Referring to FIGS. 6 and 7, a drive hub 114 with a hexagonally-shaped periphery can be fixedly attached to a shaft 116 of the stator 102 (e.g., by a set screw, a spring biased fastener, etc.). A spring housing 118 can also be attached to the shaft 116 of the stator 102 to rotate about the shaft 116. A disk of conductive material 112 with a hexagonally-shaped aperture interfaces with the drive hub 114 to remain stationary with the stator 102 as the rotor 104 turns about the stator 102. In embodiments of the disclosure, the disk of conductive material 112 can be positioned adjacent to one or more magnet housings (e.g., using screws or other fasteners). A magnet housing can include an inner housing 136 and an outer housing 138, with magnets 110 captured between the inner housing 136 and the outer housing 138.

In some embodiments, the spacing between a magnet housing and the disk of conductive material 112 can be adjusted in the field, e.g., using an adjustment mechanism. For example, the inner housing 136 and the outer housing 138 can include threaded apertures 140 and 142 that receive an end of an adjustment mechanism such as a threaded handle 144. By turning the threaded handle 144, the magnet housing can ride along rails 146 toward and away from the disk of conductive material 112. In this manner, the brake force can be set by adjusting the spacing of the magnets 110 from the disk of conductive material 112. In some embodiments, a magnet housing can be housed in an outer shell 148 that includes the rails 146. The outer shell 148 can define one or more features (e.g., surface features such as notches 150) that can interface with one or more corresponding features (e.g., a surface feature such as a tooth 152) on the threaded handle 144 to hold the threaded handle 144 in position as the cable is spooled onto the drum assembly 106. The outer shell 148 can be coupled with the spring housing 118 and the drum assembly 106, which can include a spool flange 132, a drum (not shown), and another spool flange (not shown), where the drum is positioned between the two spool flanges.

As described with reference to FIGS. 1 through 7, in some embodiments the reel device 100 may be implemented as an internal eddy current brake assembly. Referring to FIG. 8, a reel device 100 can also be implemented as an external eddy current brake assembly. For example, a disk of conductive material 112 connected to the rotor 104 interfaces with magnets 110 connected to the stator 102 to slow spooling of cable onto a drum assembly 106. In this configuration, the magnets 110 can also be arranged in the manner of a caliper, where the distance of the magnets 110 from the disk of conductive material 112 can be adjusted to set the brake force (e.g., in the manner of a brake caliper). It should also be noted that in some embodiments, one or more speed reduction mechanisms (e.g., gear reductions) may be applied to change the speed of the conductive material 112 with respect to the magnets 110 and/or the rotor 104.

Although the subject matter has been described in language specific to structural features and/or process operations, it is to be understood that the subject matter defined in the appended claims is not necessarily limited to the specific features or acts described above. Rather, the specific features and acts described above are disclosed as example forms of implementing the claims.

What is claimed is:

1. A reel device comprising:

a stator;

a rotor rotationally coupled with the stator, the rotor comprising a drum for spooling a cable;

a biasing mechanism configured to rotate the rotor to spool the cable onto the drum;

a frame fixedly attached to one of the stator or the rotor, the frame including a magnet;

a conductive material fixedly attached to the other of the stator or the rotor, the conductive material to interface with the magnet when the rotor is turned to generate eddy current and slow spooling of the cable onto the drum, the conductive material including a first conductive material housing on a first side of the frame and a second conductive material housing on a second side of the frame; and a spacer ring positioned around the frame and between the first conductive material housing and the second conductive material housing for spacing the first conductive material housing and the second conductive material housing apart from one another and from the frame.

2. The reel device as recited in claim 1, wherein the biasing mechanism comprises at least one of a spring motor, an electric motor, a pneumatic motor, or a hydraulic motor.

3. The reel device as recited in claim 1, wherein the magnet is one of a plurality of magnets connected to the at least one of the stator or the rotor.

4. The reel device as recited in claim 3, wherein the plurality of magnets is arranged in a ring.

5. The reel device as recited in claim 3, wherein the plurality of magnets is encapsulated in the frame.

6. The reel device as recited in claim 1, further comprising a magnetic shield positioned between the magnet and the biasing mechanism.

7. The reel device as recited in claim 1, wherein a distance between the magnet and the conductive material is adjustable.

8. The reel device as recited in claim 7, further comprising an adjustment mechanism for adjusting the distance between the magnet and the conductive material.

9. The reel device as recited in claim 1, wherein the magnet comprises an electromagnet, and a field strength of the electromagnet can be adjusted by adjusting current through the electromagnet.

10. A reel device comprising:

a stator;

a rotor rotationally coupled with the stator, the rotor comprising a drum for spooling a cable;

a biasing mechanism configured to rotate the rotor to spool the cable onto the drum;

a magnet connected to one of the stator or the rotor, wherein the other of the stator or the rotor includes a conductive material that interfaces with the magnet when the rotor is turned to generate eddy current and slow spooling of the cable onto the drum, the conductive material including a first conductive material housing on a first side of the magnet and a second conductive material housing on a second side of the magnet; and a spacer ring positioned around the magnet and between the first conductive material housing and the second conductive material housing for spacing the first conductive material housing and the second conductive material housing apart from one another and from the magnet.

11. The reel device as recited in claim 10, wherein the biasing mechanism comprises at least one of a spring motor, an electric motor, a pneumatic motor, or a hydraulic motor.

12. The reel device as recited in claim 10, wherein the magnet is one of a plurality of magnets connected to the at least one of the stator or the rotor.

13. The reel device as recited in claim 12, wherein the plurality of magnets is arranged in a ring.

14. The reel device as recited in claim 12, wherein the plurality of magnets is encapsulated.

15. The reel device as recited in claim 10, wherein the magnet is retained by a frame fixedly attached to the stator.

16. The reel device as recited in claim 10, wherein the magnet is retained by a frame fixedly attached to the rotor.

17. The reel device as recited in claim 10, further comprising a magnetic shield positioned between the magnet and the biasing mechanism.

18. The reel device as recited in claim 10, wherein a distance between the magnet and the conductive material is adjustable.

19. The reel device as recited in claim 18, further comprising an adjustment mechanism for adjusting the distance between the magnet and the conductive material.

20. A reel device comprising:

a stator;

a rotor rotationally coupled with the stator, the rotor comprising a drum for spooling a cable;

a spring motor configured to rotate the rotor to spool the cable onto the drum;

a frame fixedly attached to one of the stator or the rotor, the frame including a magnet;

a conductive material fixedly attached to the other of the stator or the rotor, the conductive material to interface with the magnet when the rotor is turned to generate eddy current and slow spooling of the cable onto the drum, the conductive material including a first conductive material housing on a first side of the frame and a second conductive material housing on a second side of the frame;

a spacer ring positioned around the frame and between the first conductive material housing and the second conductive material housing for spacing the first conductive material housing and the second conductive material housing apart from one another and from the frame; and a magnetic shield positioned between the magnet and the spring motor.

* * * * *